US007743798B2

(12) United States Patent
Kunii et al.

(10) Patent No.: US 7,743,798 B2
(45) Date of Patent: Jun. 29, 2010

(54) LIQUID FILLING NOZZLE

(75) Inventors: Mitsuru Kunii, Kawasaki (JP); Tsutomu Fukuda, Kawasaki (JP)

(73) Assignee: Kao Corporation, Tokyo (JP)

( * ) Notice: Subject to any disclaimer, the term of this patent is extended or adjusted under 35 U.S.C. 154(b) by 895 days.

(21) Appl. No.: 11/578,264

(22) PCT Filed: Apr. 12, 2005

(86) PCT No.: PCT/JP2005/007375

§ 371 (c)(1),
(2), (4) Date: Oct. 13, 2006

(87) PCT Pub. No.: WO2005/100162

PCT Pub. Date: Oct. 27, 2005

(65) Prior Publication Data

US 2007/0227620 A1 Oct. 4, 2007

(30) Foreign Application Priority Data

Apr. 13, 2004 (JP) ..... 2004-118375
Jan. 25, 2005 (JP) ..... 2005-017497
Jan. 25, 2005 (JP) ..... 2005-017498

(51) Int. Cl.
*B65B 3/04* (2006.01)

(52) U.S. Cl. ..... 141/90; 141/311 A; 222/571

(58) Field of Classification Search ..... 141/85, 141/89, 90, 311 A, 392; 222/571; 239/120
See application file for complete search history.

(56) References Cited

U.S. PATENT DOCUMENTS 3,857,424 A * 12/1974 Roberts ..... 141/275
5,016,687 A * 5/1991 Kawamura ..... 141/116
5,188,289 A * 2/1993 Pesho ..... 239/1
5,193,593 A * 3/1993 Denis et al. ..... 141/10
5,344,052 A * 9/1994 Divall et al. ..... 222/135
6,941,985 B2 * 9/2005 Kondo et al. ..... 141/276
2005/0150911 A1 * 7/2005 Bach ..... 222/209

FOREIGN PATENT DOCUMENTS

JP 2-56101 U 4/1990
JP 5-7696 A 2/1993
JP 6-191513 A 7/1994
JP 7-242214 A 9/1995
JP 9-86595 A 3/1997
JP 9-99914 A 4/1997
JP 9-118314 A 5/1997

(Continued)

OTHER PUBLICATIONS

Machine translation of JP 2003-112708 (Apr. 18, 2003).*

(Continued)

*Primary Examiner*—Gregory L Huson
*Assistant Examiner*—Nicolas A Arnett
(74) *Attorney, Agent, or Firm*—Birch, Stewart, Kolasch & Birch, LLP

(57) ABSTRACT

There is provided a liquid filling nozzle 12 with at least one net-like body 23 provided at a discharge port 22 of a nozzle main body 21, in which the net-like body 23 is provided on an external side of the discharge port 22.

6 Claims, 13 Drawing Sheets

FOREIGN PATENT DOCUMENTS

| | | | |
|---|---|---|---|
| JP | 9-240786 | A | 9/1997 |
| JP | 2003-112708 | A | 4/2003 |
| JP | 2003-237734 | A | 8/2003 |
| WO | WO-01/76945 | A1 | 10/2001 |

OTHER PUBLICATIONS

English language abstract of JP-2003-112708-A (Apr. 18, 2003).
English language abstract of JP-5-7696-U (Feb. 2, 1993).

* cited by examiner

LIQUID FILLING NOZZLE

TECHNICAL FIELD

The present invention relates to a liquid filling nozzle.

BACKGROUND ART

As a liquid filling nozzle into a container such as a bag, there is a nozzle in which a net-like body is provided at a discharge port of a nozzle main body as disclosed in Japanese Patent Application Laid-open No. 9-118314(Patent Document 1). In this liquid filling nozzle, by passing liquid through the net-like body, the liquid is made flow straight to prevent occurrence of bubbling when the liquid is filled into the container.

In the liquid filling nozzle in the Patent Document 1, the net-like body is fixed to the discharge port in a through hole shape of the nozzle main body from inside. Therefore, the net-like body is provided inside an inside diameter of the discharge port. Therefore, when filling from the liquid filling nozzle has been finished, the liquid to be filled and existing in a region of a bore (inside the bore) of the discharge port adheres to meshes of the net-like body to form liquid accumulation and also adheres to a portion of the inside diameter portion of the discharge hole positioned on an external side of the net-like body to form liquid accumulation. Such liquid accumulation causes liquid dripping as the liquid spatters around the nozzle when it is not filled into the container.

DISCLOSURE OF THE INVENTION

Objects of the present invention are to make liquid flow straight in a liquid filling nozzle to prevent liquid dripping.

The invention is a liquid filling nozzle with a material body having a capillary action provided around an opening of a discharge port.

Further, the invention is a liquid filling nozzle with at least one net-like body provided out of the discharge port of a nozzle main body, wherein the net-like body is provided on an external side of the discharge port.

Moreover, the invention is a liquid filling nozzle with a net-like body provided at a discharge port of a nozzle main body, wherein the net-like body is provided at or in a vicinity of an opening of the discharge port and a material body having a capillary action extends around the opening so as to contact with an outer edge of the net-like body.

BEST MODE FOR CARRYING OUT THE INVENTION

Figure 1:
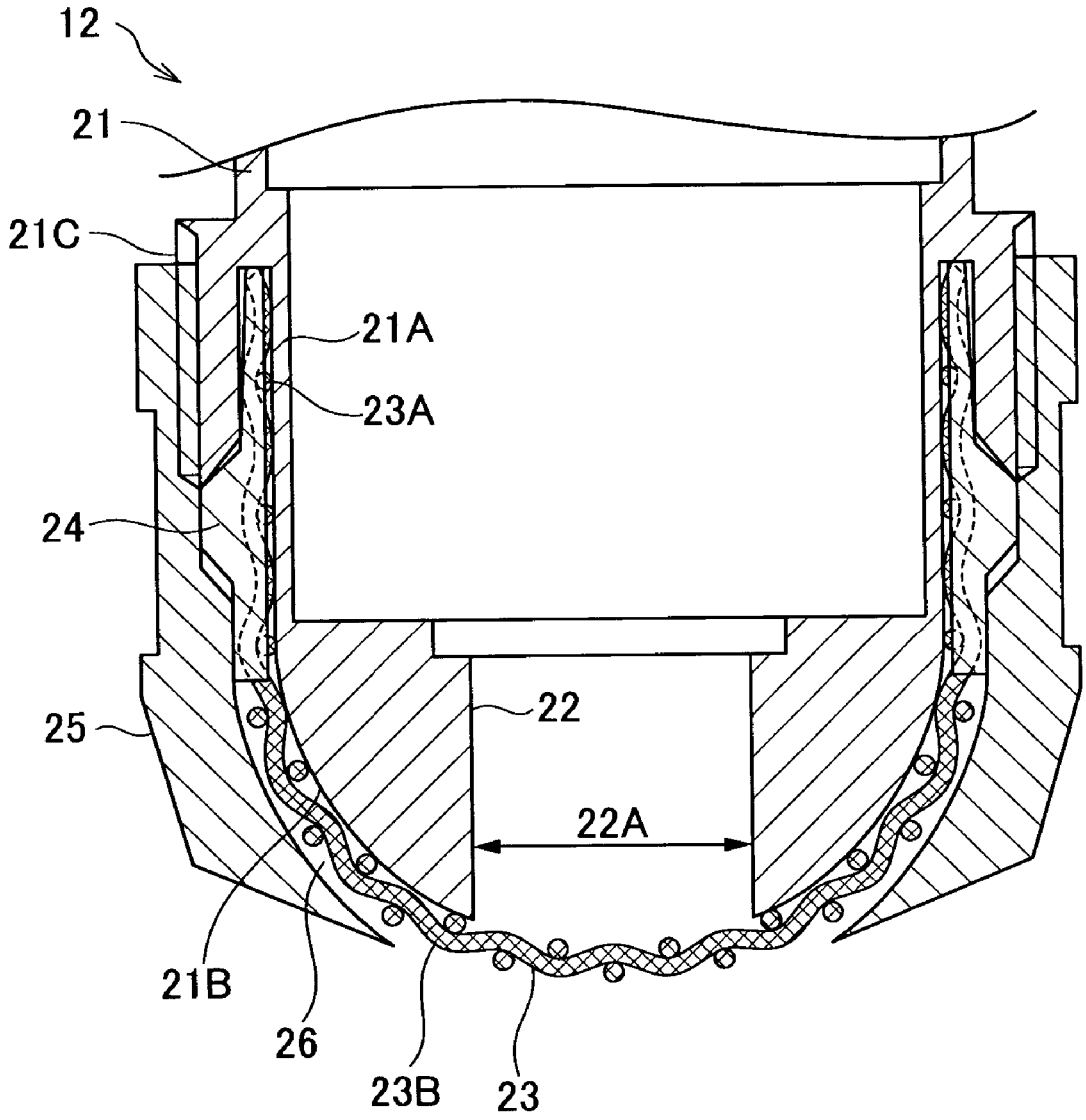
FIG. 1 is a sectional view of a liquid filling nozzle of an embodiment 1.

Embodiment 1 FIGS. 1 to 5, FIG. 9

In a liquid filling device 10, as shown in FIGS. 4(A), 4(B), 5(A), and 5(B), a switching valve 14 of a pump 15 is connected to a liquid filling head 11 including a filling nozzle 12 and a discharge valve 13. A liquid feed pipe 16 is also connected to the switching valve 14.

Figure 2:
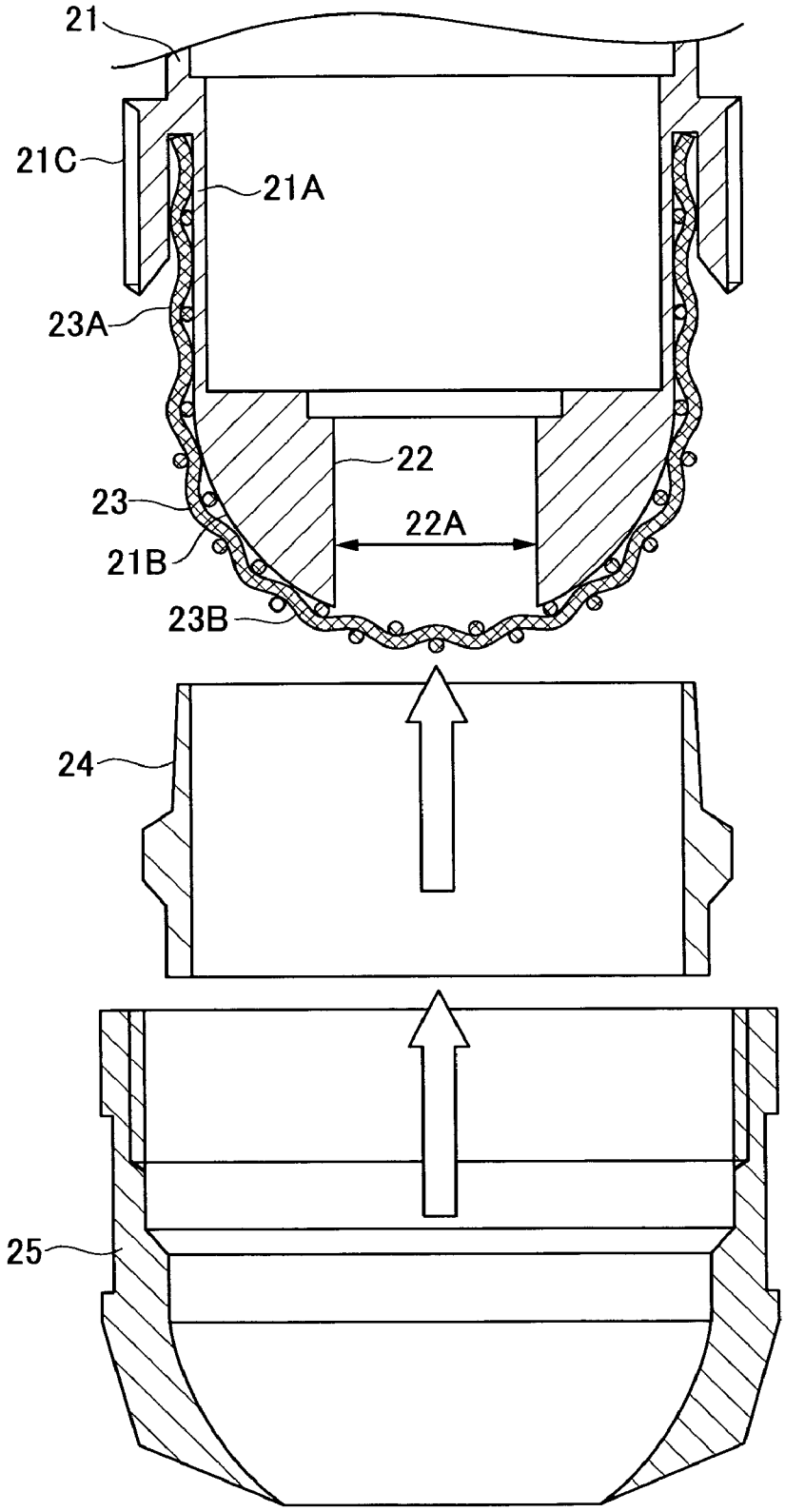
FIG. 2 is an exploded view of the liquid filling nozzle.

As shown in FIGS. 1 and 2, the filling nozzle 12 includes one net-like body 23 spreading on a front face of a discharge port 22 of a nozzle main body 21 and around the front face. The net-like body 23 is formed of a tube portion 23A and a hemispherical face portion 23B contiguous to a tip end side of the tube portion 23A. By mounting a tubular net retainer 24 to an outer periphery of the tube portion 23A fitted over a tubular outer peripheral portion 21A of the nozzle main body 21, the net-like body 23 is fixed to the nozzle main body 21. A cover-like net support 25 forming a discharge port peripheral wall portion is mounted to outer peripheries of the hemispherical face portion 23B attached to a hemispherical outer peripheral portion 21B of the nozzle main body 21 and the net retainer 24 and the net support 25 is screwed over an outer peripheral thread portion 21C of the nozzle main body 21. The net support 25 and the nozzle main body 21 may be fixed to each other by a clamp.

The filling nozzle 12 includes the net-like body 23 on an external side of the discharge port 22 of the nozzle main body 21 along a discharge direction (on an external side of an opening 22A of the discharge port 22).

In the filling nozzle 12, the net-like body 23 spreads around the discharge port 22 of the nozzle main body 21 when seen from outside the discharge port 22 in the discharge direction (from below in FIG. 1). In the present embodiment, the net-like body 23 extends along the tubular outer peripheral portion 21A and the hemispherical outer peripheral portion 21B of the nozzle main body 21. It is also possible that the net-like body 23 extends while spaced from the outer wall of the nozzle main body 21 without extending along the outer peripheral portion 21A or the hemispherical outer peripheral portion 21B of the nozzle main body 21.

The filling nozzle 12 includes the net support 25 at the outer periphery of the discharge port 22 of the nozzle main body 21 and a clearance 26 between the net support 25 and an outer face (the tubular outer peripheral portion 21A, the hemispherical outer peripheral portion 21B) of the nozzle main body 21. In the clearance 26, a portion of the net-like body 23 spreading around the discharge port 22 (a part of the hemispherical face portion 23B) exists. In other words, the net-like body 23 is sandwiched between the nozzle main body 21 and the net support 25 forming the discharge port peripheral wall portion around the discharge port 22.

Filling of the liquid into a bag (standing pouch) or the like by the liquid filling nozzle 10 is carried out as follows.

(1) The switching valve 14 of the pump 15 is connected to the liquid feed pipe 16 and a piston of the pump 15 is pulled to measure the liquid in a cylinder of the pump 15 (FIG. 4(A)).

(2) The switching valve 14 of the pump 15 is connected to the filling head 11, the discharge valve 13 is opened, and the piston of the pump 15 is pushed to discharge the liquid in the cylinder from the filling nozzle 12 (FIG. 4(B)). At this time, the discharged liquid is made flow straight when the liquid passes through the net-like body 23 of the filling nozzle 12 and is prevented from bubbling.

(3) Just before the filling in above-described (2) is finished, the piston of the pump 15 is pulled a little to reduce a liquid pressure (a liquid flowing amount) from the switching valve 14 to the filling nozzle 12 to reduce liquid remaining in the filling nozzle 12 at the end of the filling (FIG. 5(A)).

In cleaning the liquid filling device 10, as shown in FIG. 5(B), a sealing portion 17A of a cleaning cup 17 is brought into close contact with an outer face of the net support 25 of the filling nozzle 12 and a cleaning liquid pressure-fed by the pump 15 is discharged into the cleaning cup 17 through the filling head 11.

Figure 3:
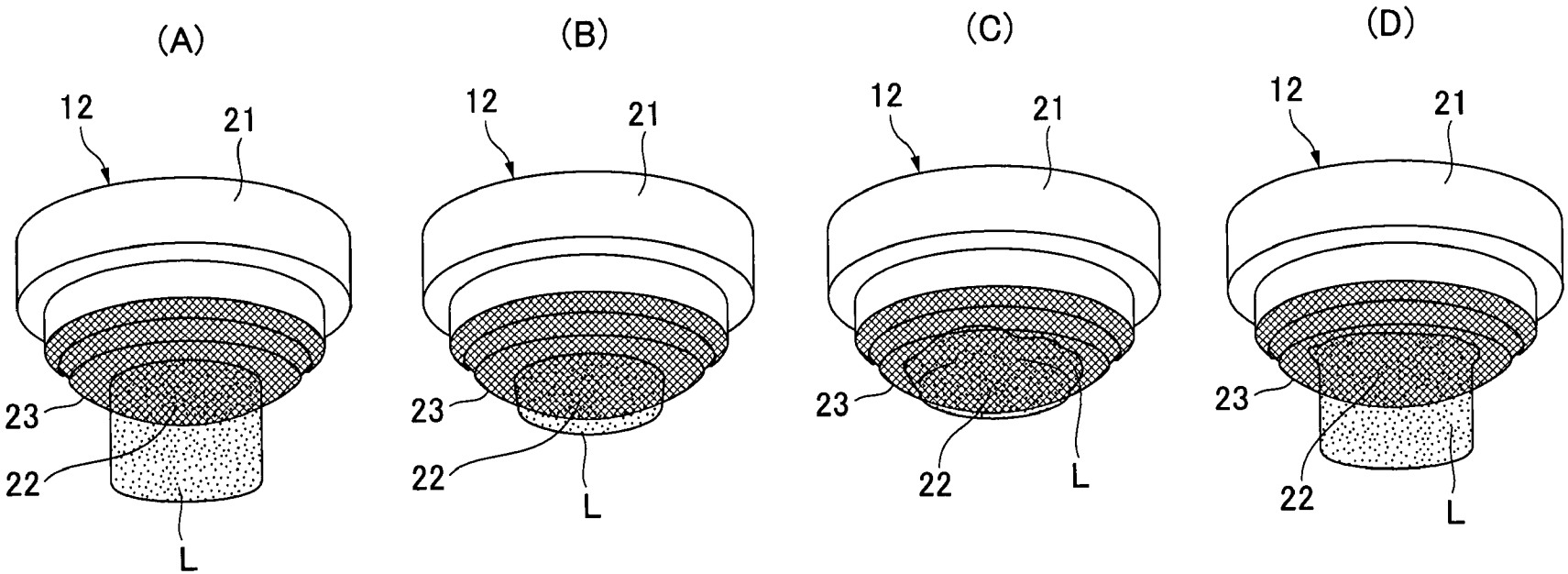
FIGS. 3(A) to 3(D) are schematic drawings showing a liquid dripping preventing mechanism of the liquid filling nozzle.

In the liquid filling device 10, liquid dripping from the filling nozzle 12 after the filling has finished is prevented as follows (see FIGS. 3(A) to 3(D)). In FIG. 3, in order to show change in a region in which the liquid is caught by the net-like body 23 spreading to the outer periphery of the nozzle main body 21, the net retainer 24 and the net support 25 at the outer periphery of the nozzle main body 21 are not shown.

(1) In filling from the filling nozzle 12 into the container, the liquid L is discharged from the discharge port 22 of the nozzle main body 21 through the net-like body 23 (FIG. 3(A)).

(2) When the filling from the filling nozzle 12 has been finished, the liquid is held by the net-like body 23 in a region of the opening 22A of the discharge port 22. The held liquid forms liquid accumulation (FIG. 3(B)).

(3) A part of the liquid in the opening 22A is drawn by a capillary action of meshes outside the opening 22A, i.e., meshes around the discharge port 22 of the net-like body 23 and moves into the meshes (FIG. 3(C)). A part of the liquid forming the liquid accumulation in above-described (2) reaches the clearance 26 between the net support 25 outside the opening 22A and the outer face of the nozzle main body 21.

(4) While the next filling from the filling nozzle 12, by the action of a negative pressure exerted on the periphery by the liquid discharged from the discharge port 22 of the nozzle main body 21 through the net-like body 23, the liquid accumulation in above-described (2) and the liquid that has moved to the peripheral portion of the discharge port 22 and the clearance 26 in above-described (3) are discharged outside the filling nozzle 12 together with the discharged liquid.

In order to prevent liquid dripping after the filling from the filling nozzle 12 has finished, an area of the net-like body 23 is preferably 1.2 times an area of the discharge port 22 or larger and is more preferably twice or larger. Depending on a kind of liquid to be discharged, it is estimated that a minimum amount of liquid expected to adhere to meshes existing in the opening 22A of the discharge port 22 to cause the liquid dripping can be held by providing the net-like body 23 having the surface area that is 1.2 times the area of the discharge port 22 and it is estimated that an expected maximum amount of liquid can be held by providing the net-like body 23 having the surface area that is twice the area of the discharge port 22.

Figure 9:
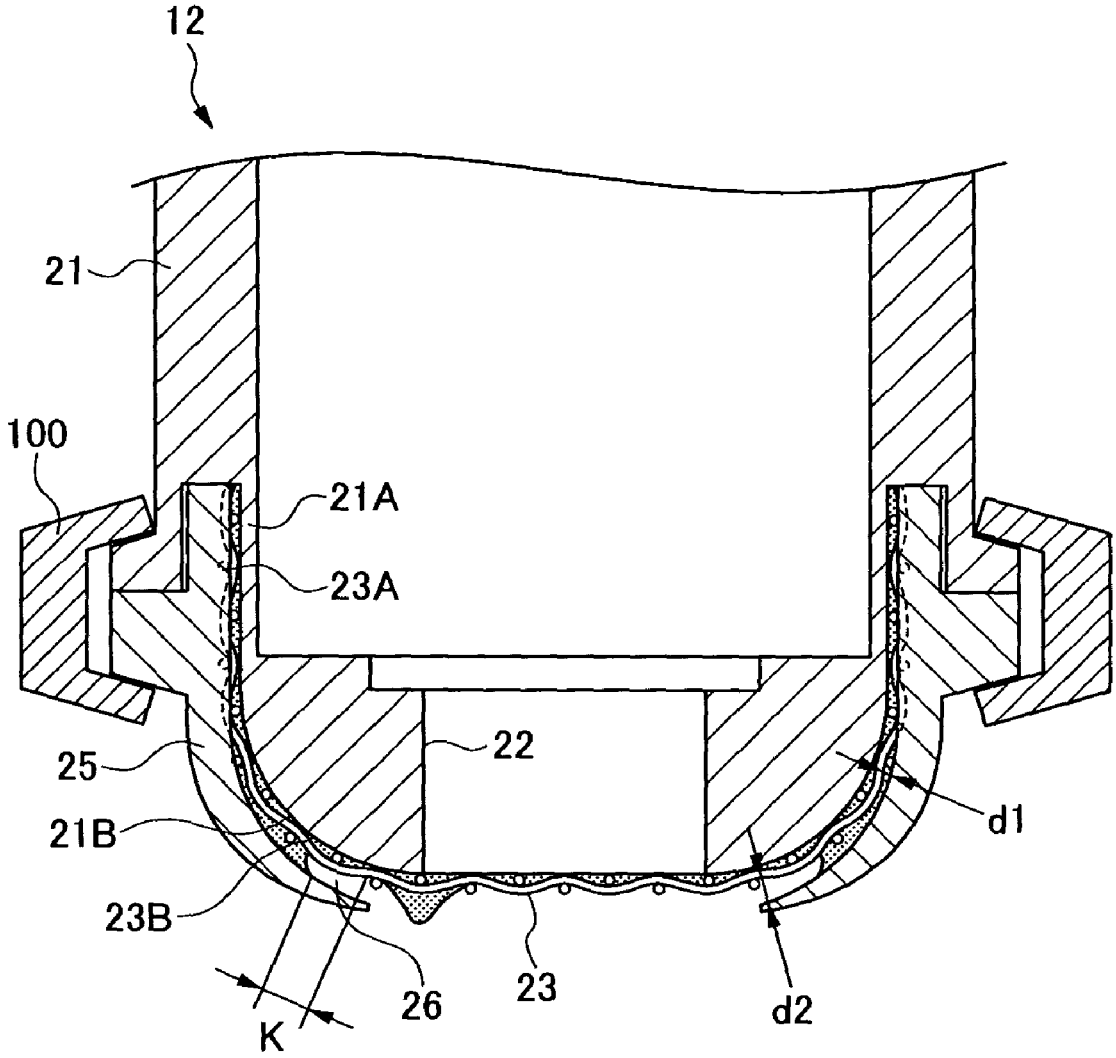
FIG. 9 is a sectional view of a state of a clearance between a net support and a nozzle main body of the liquid filling nozzle.

In the filling nozzle 12, the clearance 26 between the net support 25 and the outer face of the nozzle main body 21 preferably widens as it approaches the discharge port 22. To put it concretely, when a liquid detergent is employed as the liquid to be filled, as shown in FIG. 9, if the clearance d1 at a portion of the net support 25 at a distance of 10 mm in an upward direction from the discharge port 22 is 0.5 mm, the clearance d2 at a lowermost portion of the net support 25 that is the closest to the discharge port 22 is 2 mm. By widening the clearance 26 between the net support 25, i.e., the discharge port peripheral wall portion and the outer face of the nozzle main body 21 as the clearance 26 approaches the discharge port 22, the liquid existing at an inner face of the lowermost portion (a region of the diameter) of the net support 25 can be reduced or avoided depending on conditions to eventually contribute to prevention of occurrence of the liquid dripping. Incidentally, FIG. 9 shows a filling nozzle 12 in which the net support 25 and the nozzle main body 21 are fixed to each other by a clamp 100.

With the present embodiment, the following operation and effects can be exerted.

(a) In the filling nozzle 12, the net-like body 23 that functions as a means for making the discharged liquid flow straight to make the liquid flow straight is provided on the external side of the inside diameter portion (opening 22A) of the discharge port 22 in the nozzle main body 21. With this configuration, because the net-like body 23 directly faces the outside in a direction along the discharge direction of the liquid, the liquid remaining when the filling from the filling nozzle 12 has been finished may adhere to the meshes of the net-like body 23 existing in a region (inside the bore) of the opening 22A of the discharge port 22 and may be held in the meshes to form liquid accumulation but does not form the liquid accumulation that causes the liquid dripping on the external side of the net-like body 23.

(b) Because the net-like body 23 spreads to the periphery of the discharge port 22 when that was seen from outside the discharge port 22 in the direction of discharge, when the filling has been finished, a part of the liquid accumulation that has adhered to the meshes of the net-like body 23 in the range of the opening 22A of the discharge port 22 is drawn by a capillary action of the net-like body 23 spreading outside the opening 22A and is held in the meshes outside the region of the opening 22A. In other words, the region in which the liquid is held by the net-like body 23 is not only in the opening 22A of the discharge port 22 but also extended to outside the opening 22A so as to thereby further prevent the liquid dripping.

(c) By attaching the net support 25 to the outer periphery of the discharge port 22 of the nozzle main body 21 and providing the clearance 26 between the net support (discharge port peripheral wall portion) 25 and the outer face of the nozzle main body 21, when the filling from the filling nozzle 12 has been finished, a part of the liquid that has adhered to the meshes of the net-like body 23 in the opening 22A of the discharge port 22 is drawn into the clearance 26 between the net support 25 outside the opening 22A and the outer face of the nozzle main body 21 and is held in the clearance 26 to thereby further prevent the liquid dripping.

(d) The liquid held in the meshes of the net-like body 23 existing in the opening 22A of the discharge port 22 in above-described (a), the liquid held in the meshes of the net-like body 23 outside the opening 22A in above-described (b), and the liquid held between the net support (discharge port peripheral wall portion) 25 and the outer face of the nozzle main body 21 in above-described (c) are respectively discharged outside the filling nozzle 12 together with the discharged liquid by the action of the negative pressure exerted on the periphery by the liquid discharged from the discharge port 22 in the next filling from the filling nozzle 12. Therefore, it is possible to reduce a possibility that the liquids in above-described (a) to (c) grow into the liquid accumulation to thereby prevent the liquid dripping caused by the liquid accumulation that takes a long time to form.

Figure 6:
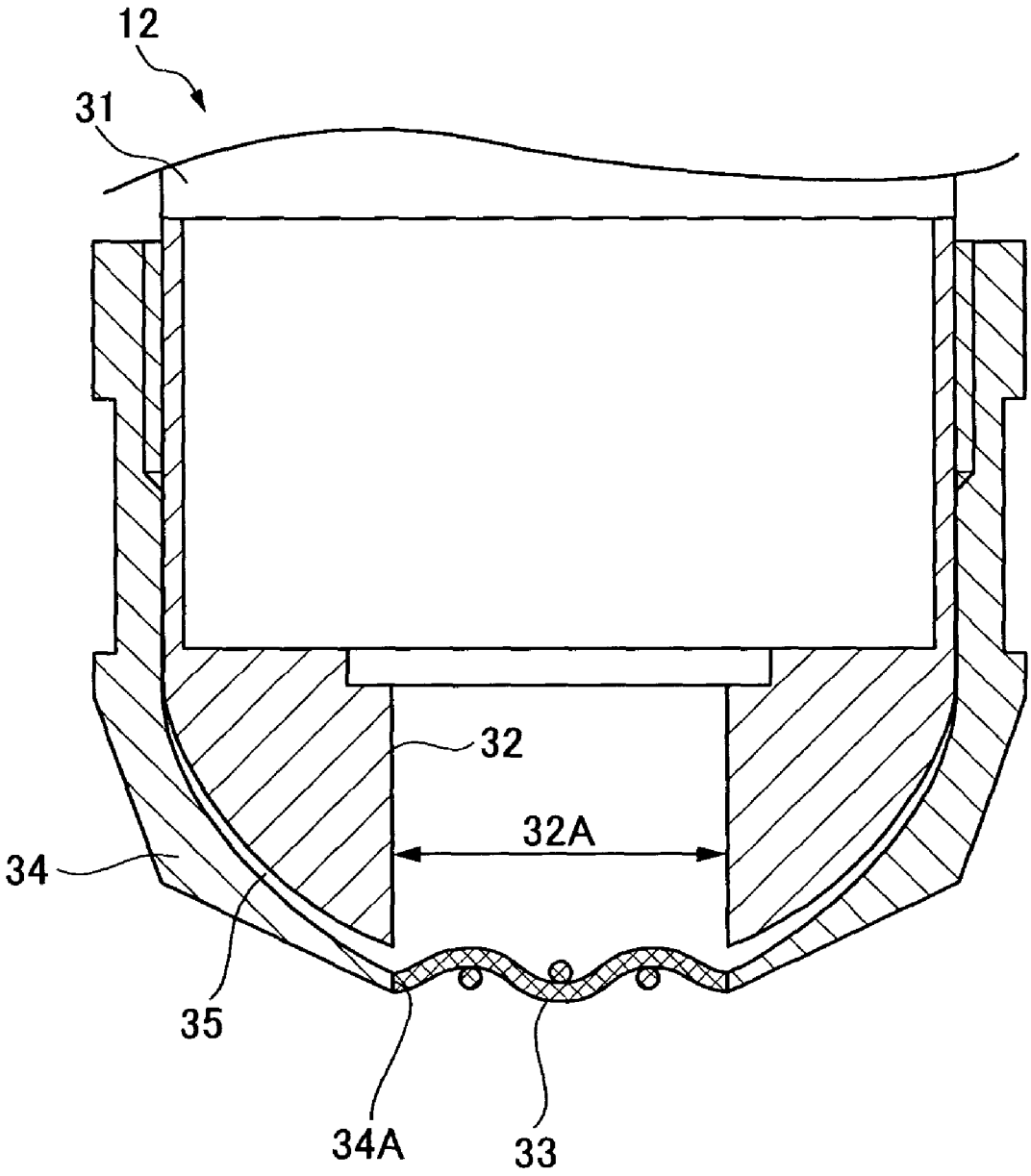
FIG. 6 is a sectional view of a liquid filling nozzle of an embodiment 2.
Figure 7:
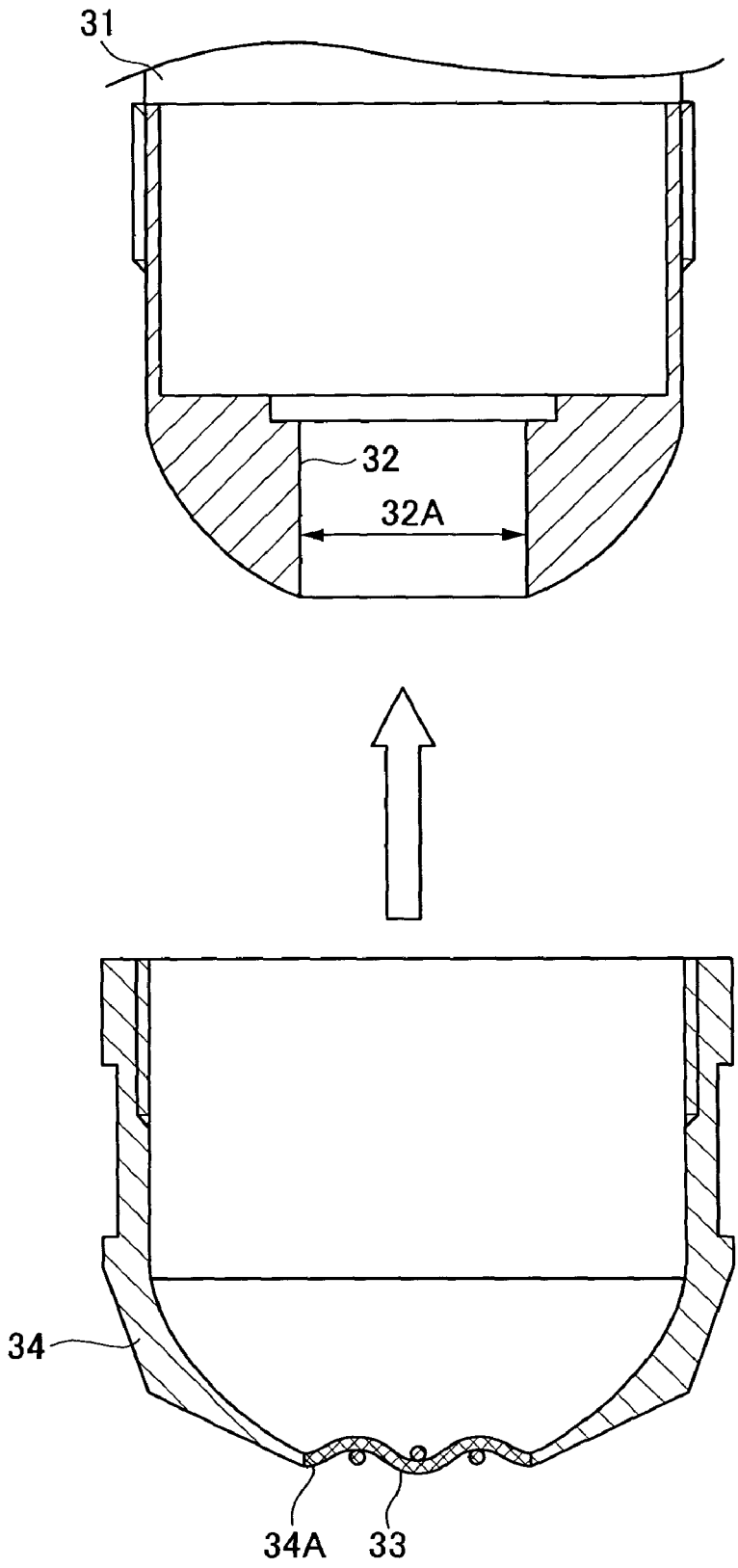
FIG. 7 is an exploded view of the liquid filling nozzle.

Embodiment 2 FIGS. 6, 7

In the filling nozzle 12 in embodiment 2, as shown in FIGS. 6 and 7, in providing a net-like body 33 on a front face (a front face and an outer periphery as necessary) along the discharge direction of a discharge port 32 of a nozzle main body 31, an outer edge of the net-like body 33 is connected to an inner edge of a central hole portion 34A of a cover-like net support 34 screwed over (or fixed by a clamp to) an outer periphery of the nozzle main body 31 so that the outer edge and the inner edge are integrated with each other.

In the filling nozzle 12, the net-like body 33 is provided on an external side of the discharge port 32 of the nozzle main body 31 along the discharge direction (outside an opening 32A of the discharge port 32).

The filling nozzle 12 includes the net support 34 forming a discharge port peripheral wall portion on the outer periphery of the discharge port 32 of the nozzle main body 31 and a clearance 35 between the net support 34 and an outer face of the nozzle main body 31.

Therefore, in the liquid filling device 10, dripping from the filling nozzle 12 after the filling has been finished is prevented as follows.

(1) In filling from the filling nozzle 12 into the container, the liquid is discharged from the discharge port 32 through the net-like body 33.

(2) When the filling from the filling nozzle 12 has been finished, the liquid is held by the net-like body 33 in a region of the opening 32A of the discharge port 32. The held liquid forms liquid accumulation.

(3) A part of the liquid forming the liquid accumulation in above-described (2) in the opening 32A is drawn by a capillary action of the clearance 35 between the net support 34 existing outside the opening 32A and the outer face of the nozzle main body 31 and reaches an inside of the clearance 35.

(4) In the next filling from the filling nozzle 12, by the action of a negative pressure exerted on the periphery by the liquid discharged from the discharge port 32 through the net-like body 33, the liquid accumulation in above-described (2) and the liquid that has moved into the clearance 35 in above-described (3) are discharged outside the filling nozzle 12 together with the discharged liquid.

With the present embodiment, the following operation and effects can be exerted.

(a) In the filling nozzle 12, the net-like body 33 that functions as a means for making the discharged liquid flow straight to make the liquid flow straight is provided on the external side of the inside diameter portion of the discharge port 32 in the nozzle main body 31.

Therefore, the net-like body 33 directly faces the outside in a direction along the discharge direction of the liquid. The liquid remaining when the filling from the filling nozzle 12 has been finished may adhere to the meshes of the net-like body 33 existing in a region (inside the opening) of the opening 32A of the discharge port 32 and may be held in the meshes to form liquid accumulation but does not form the liquid accumulation that causes the liquid dripping on the external side of the net-like body 33.

(b) Because the net support 34 is provided on the outer periphery of the discharge port 32 of the nozzle main body 31 and the clearance 35 is provided between the net support (discharge port peripheral wall portion) 34 and the outer face of the nozzle main body 31, when the filling from the filling nozzle 12 has been finished, a part of the liquid that has adhered to the meshes of the net-like body 33 existing in the opening 32A of the discharge port 32 is drawn into the clearance 35 between the net support 34 outside the opening 32A and the outer face of the nozzle main body 31 and held in the clearance 35 to thereby further prevent the liquid dripping.

(c) The liquid held in, the meshes of the net-like body 33 existing in the opening 32A of the discharge port 32 in above-described (a) and the liquid held between the net support (discharge port peripheral wall portion) 34 and the outer face of the nozzle main body 31 in above-described (b) are respectively discharged outside the filling nozzle 12 together with the discharged liquid by the action of the negative pressure exerted on the periphery by the liquid discharged from the discharge port 32 in the next filling from the filling nozzle 12. Therefore, it is possible to reduce a possibility that the liquids in above-described (a) and (b) grow into the liquid accumulation to thereby prevent the liquid dripping caused by the liquid accumulation that takes a long time to form.

Figure 8:
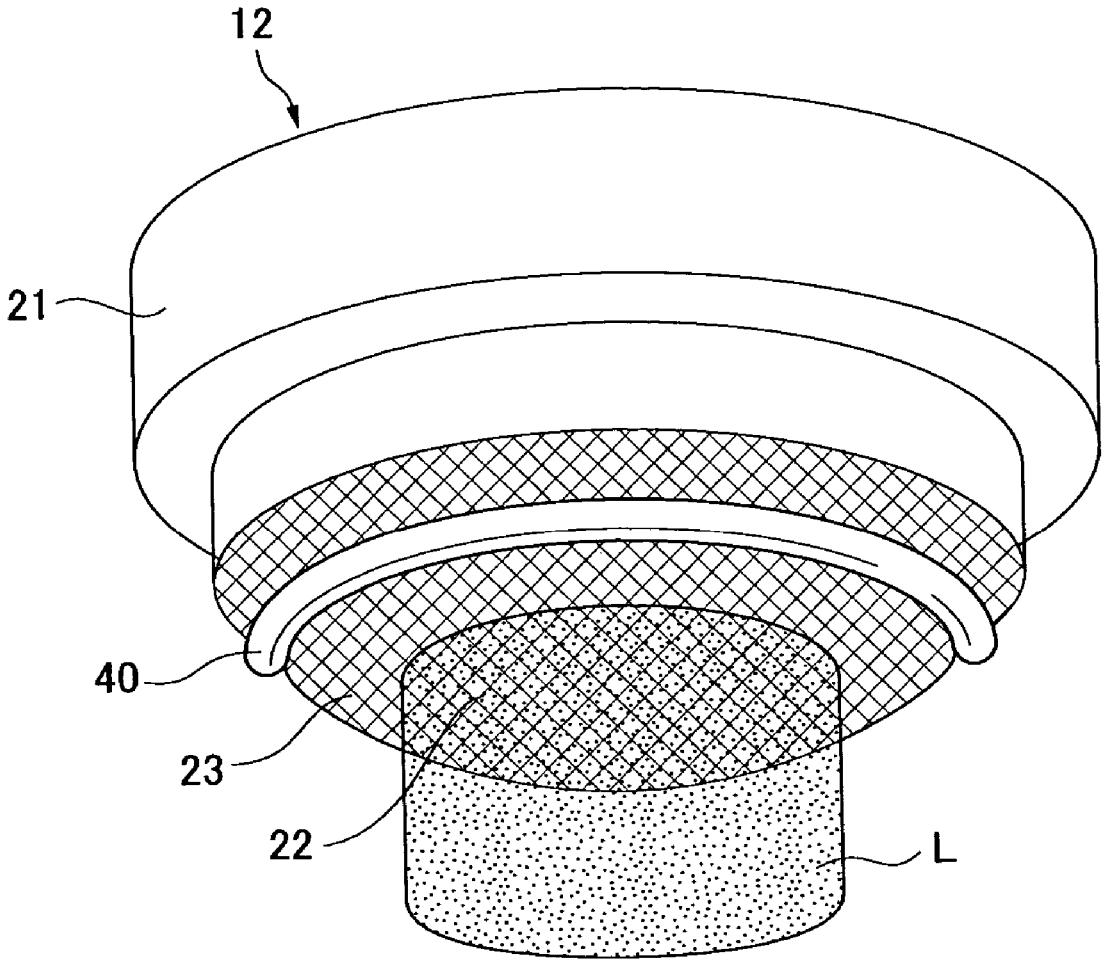
FIG. 8 is a perspective view of a liquid filling nozzle of an embodiment 3.

Embodiment 3 FIG. 8

In the filling nozzle 12 of an embodiment 3, as shown in FIG. 8, the net-like body 23 is fixed to the nozzle main body 21 by using an O-ring 40.

Figure 10:
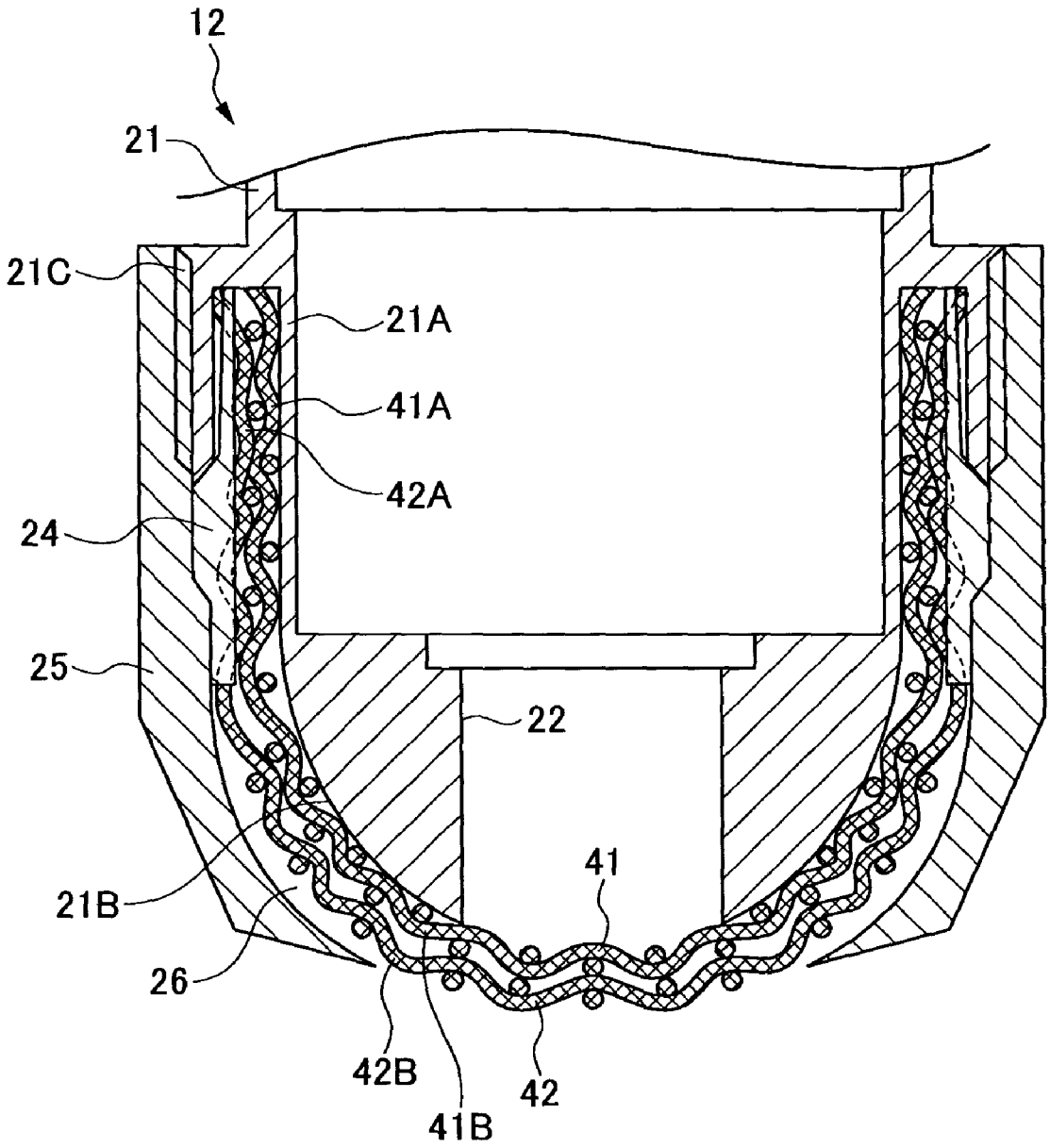
FIG. 10 is a sectional view of a liquid filing nozzle of an embodiment 4.

Embodiment 4 FIG. 10

In the filling nozzle 12 of an embodiment 4, as shown in FIG. 10, one net-like body 23 stretched on the discharge port 22 of the nozzle main body 21 in the filling nozzle 12 in the embodiment 1 is replaced by two stacked net-like bodies 41, 42. In both the net-like bodies 41, 42, hemispherical portions 41B, 42B are contiguous with tip end sides of tube portions 41A, 42A. The net-like bodies 41, 42 are fixed to the nozzle main body 21 by mounting the tubular net retainer 24 on an outer periphery of the tube portions 41A, 42A fitted over the tubular outer peripheral portion 21A of the nozzle main body 21, mounting the cover-like net support 25 to outer peripheries of the hemispherical face portions 41B, 42B attached to the hemispherical outer peripheral portion 21B of the nozzle main body 21 and the net retainer 24, and screwing the net support 25 over an outer peripheral thread portion 21C of the nozzle main body 21.

In the invention, with regard to a size of the mesh of the net-like body, a length of a side of a mesh opening is preferably 0.14 to 2.07 mm (#100 to #10) and a thickness of a strand forming the net is preferably $\phi$0.1 to $\phi$0.47 mm. Especially in case of a liquid having a viscosity of about 1 to 2500 mPa·s, the mesh opening having dimensions in the above-described ranges holds the liquid. The liquid held in the mesh opening is discharged along with a flow of the liquid discharged from the nozzle discharge port in every filling to thereby avoid the necessity for special maintenance for maintaining the liquid dripping preventing performance.

In the liquid filling device 10 in the embodiment 1, the present inventors formed the filling nozzle 12 by using a 20-mesh net-like body 23 formed of polyethylene strand having a strand diameter of 0.345 mm, used this liquid filling device 10 for filling a liquid detergent having a viscosity of 21 mPa·s and specific gravity of 1.007 and at liquid temperature of 20° C., and obtained satisfactory results in terms of both the liquid discharge performance and liquid dripping preventing performance.

In the liquid filling device 10 in the embodiment 1, the present inventors formed the filling nozzle 12 by stacking two 20-mesh net-like bodies 41, 42 formed of SUS304 strand having a strand diameter of 0.2 mm, used this liquid filling device 10 for filling a liquid detergent having a viscosity of about 100 mPa·s and specific gravity of 1.04 and at liquid temperature of 20° C., and obtained satisfactory results in terms of both the liquid discharge performance and liquid dripping preventing performance.

Figure 11:
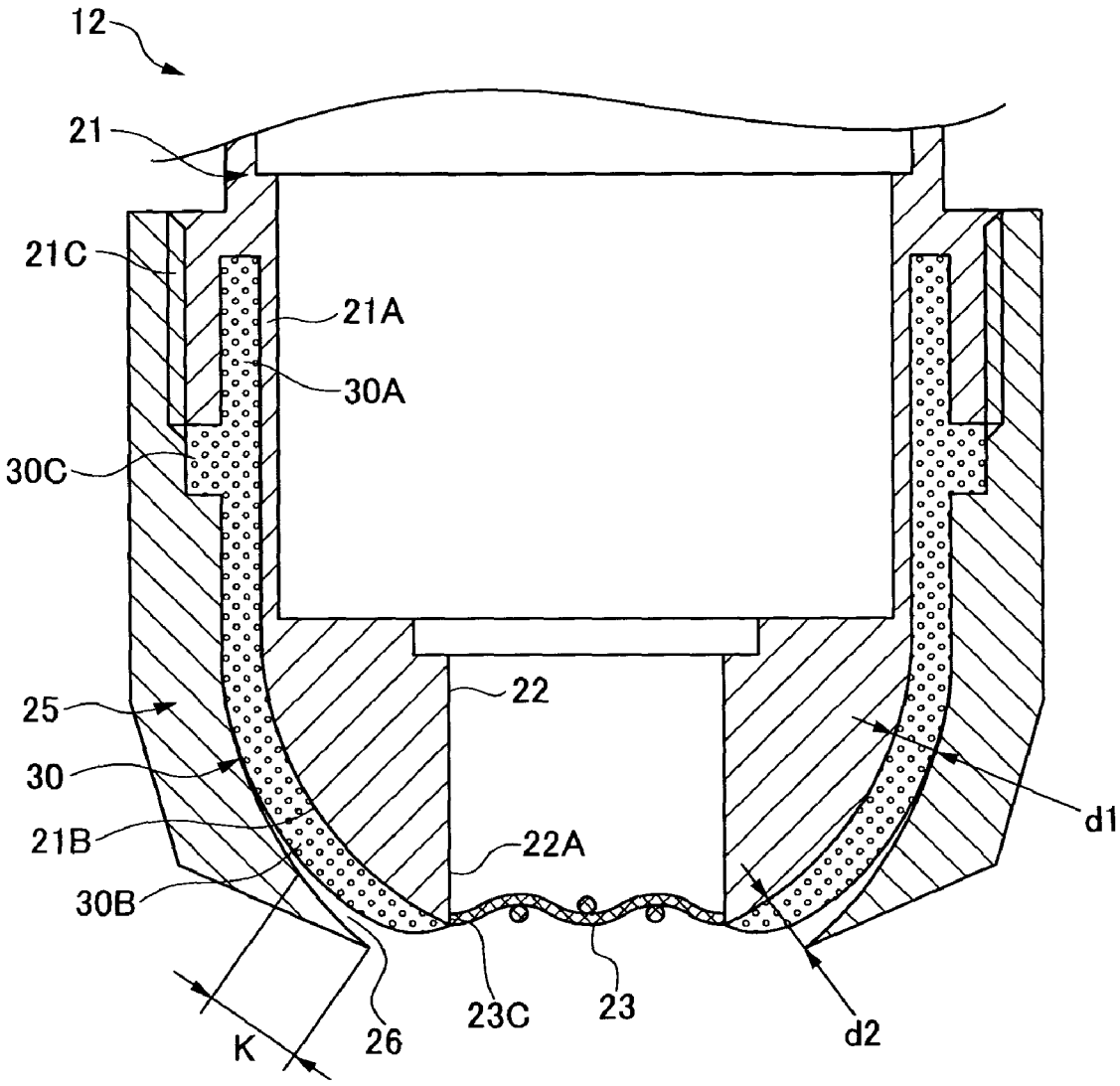
FIG. 11 is a sectional view of a liquid filing nozzle of an embodiment 5.
Figure 12:
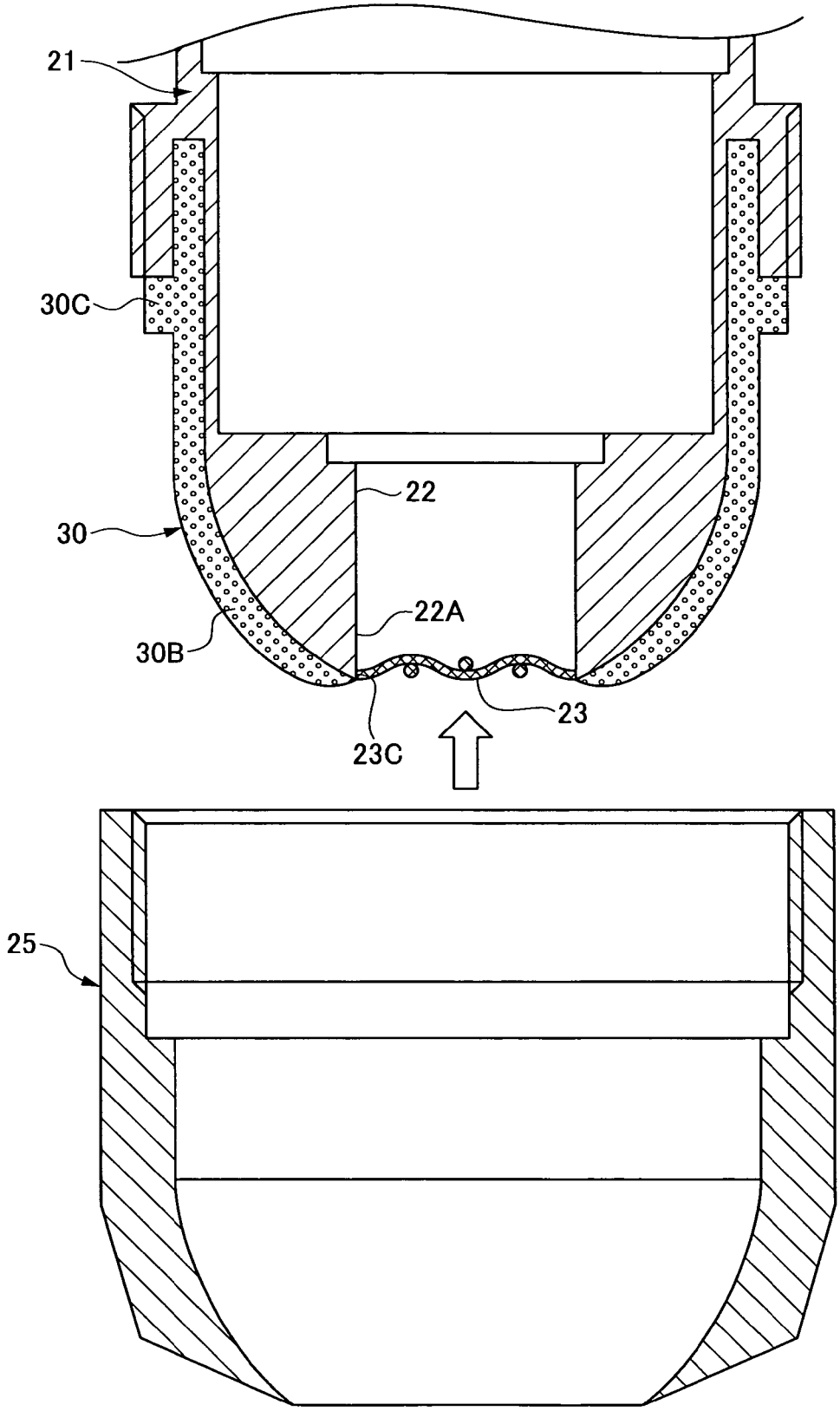
FIG. 12 is an exploded view of the liquid filling nozzle.
Figure 13:
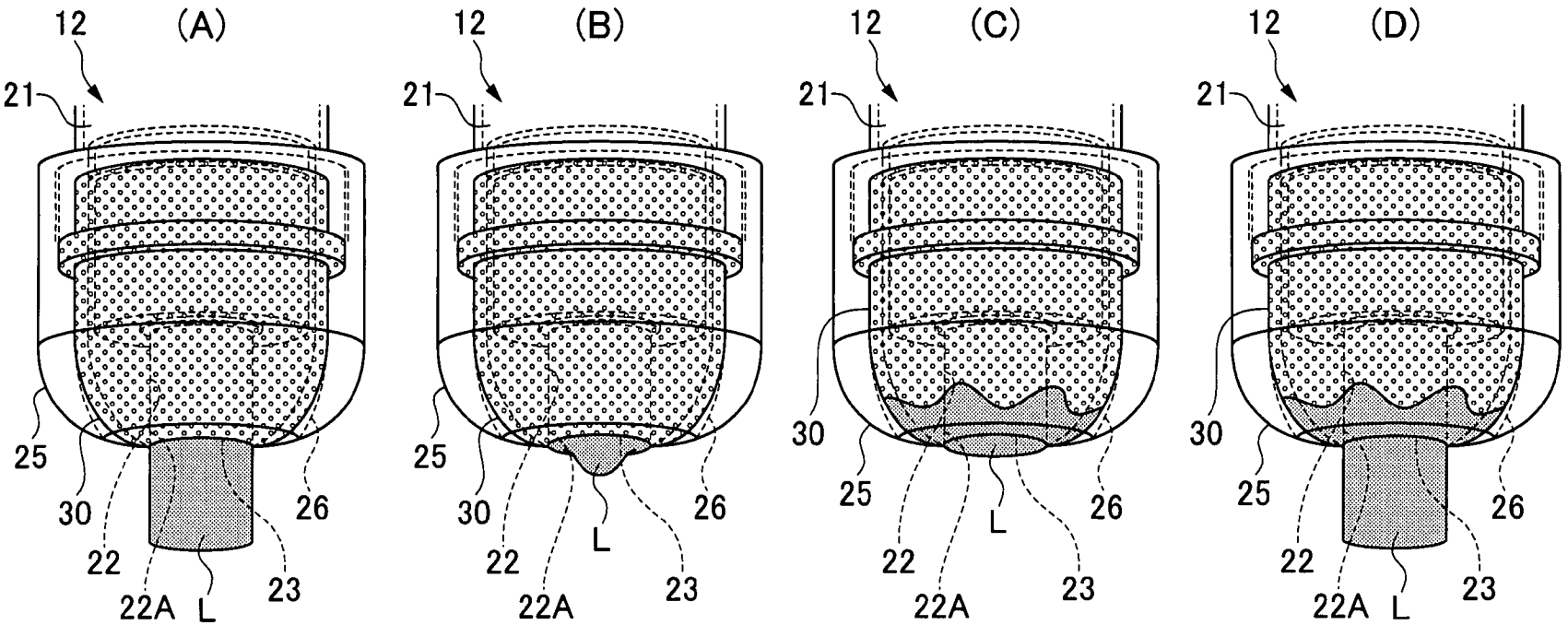
FIGS. 13(A) to 13(D) are schematic drawings showing a liquid dripping preventing mechanism of the liquid filling nozzle.

Embodiment 5 FIGS. 11 to 13

In the present embodiment, similarly to the embodiment 1, in the liquid filling device 10, the switching valve 14 of the pump 15 is connected to the liquid filling head 11 having the filling nozzle 12 and the discharge valve 13. To the switching valve 14, the liquid feed pipe 16 is also connected.

In the filling nozzle 12, as shown in FIGS. 11 and 12, the net-like body 23 is stretched on the discharge port 22 of the nozzle main body 21. The net-like body 23 is provided in or near the opening 22A of the discharge port 22 facing the outside in the discharge direction (provided on a front face in the bore of the opening 22A in the present embodiment).

In the filling nozzle 12, a material body 30 having a capillary action extends around the opening 22A of the discharge port 22 so as to be in contact with an entire circumference of an outer edge 23C of the net-like body 23. The material body 30 having the capillary action is formed of a tubular portion 30A and a hemispherical face portion 30B contiguous with a tip end side of the tubular portion 30A. The cover-like net support 25 forming a discharge port peripheral wall portion is mounted to outer peripheries of the tubular portion 30A fitted over the tubular outer peripheral portion 21A of the nozzle main body 21 and the hemispherical face portion 30B attached to the hemispherical outer peripheral portion 21B of the nozzle main body 21 and the support 25 is screwed over the outer peripheral thread portion 21C of the nozzle main body 21. Between a step face of the support 25 and an end face of the nozzle main body 21, an outer peripheral flange 30C of the material body 30 having the capillary action is sandwiched. The support 25 and the nozzle main body 21 may be fixed to each other by a clamp.

In the filling nozzle 12, the material body 30 having the capillary action spreads around the discharge port 22 when seen from outside the discharge port 22 of the nozzle main body 21 in the discharge direction (from below in FIG. 11). In the present embodiment, the material body 30 having the capillary action extends along the tubular outer peripheral portion 21A and the hemispherical outer peripheral portion 21B of the nozzle main body 21. It is also possible that the material body 30 having the capillary action extends while spaced from the outer wall of the nozzle main body 21 without extending along the outer peripheral portion 21A or the hemispherical outer peripheral portion 21B of the nozzle main body 21.

The filling nozzle 12 includes the support 25 at the outer periphery of the discharge port 22 of the nozzle main body 21 as described above and there is the clearance 26 between the support 25 and the outer face (the tubular outer peripheral portion 21A, the hemispherical outer peripheral portion 21B) of the nozzle main body 21. In the clearance 26, a portion of the material body 30 spreading around the discharge port 22 (a part of the hemispherical face portion 30B) exists. In other words, the material body 30 is sandwiched between the nozzle main body 21 and the support 25 forming the discharge hole peripheral wall portion around the discharge port 22.

Here, the clearance 26 between the support 25 and the outer face of the nozzle main body 21 preferably widens as it approaches the discharge port 22. To put it concretely, when a liquid detergent is employed as the liquid to be filled, as shown in FIG. 11, if the clearance d1 at a portion at a distance of 10 mm in an upward direction from a lowermost portion of the support 25 that is the closest to the discharge port 22 is 0.5 mm, the clearance d2 at the lowermost portion of the support 25 that is the closest to the discharge port 22 is 2 mm. In FIG. 11, the liquid held in the clearance 26 as will be described later does not come in contact with an inner face (a region K) of the lowermost portion of the support 25 that is the closest to the discharge port 22 and the liquid dripping does not occur.

Figure 4:
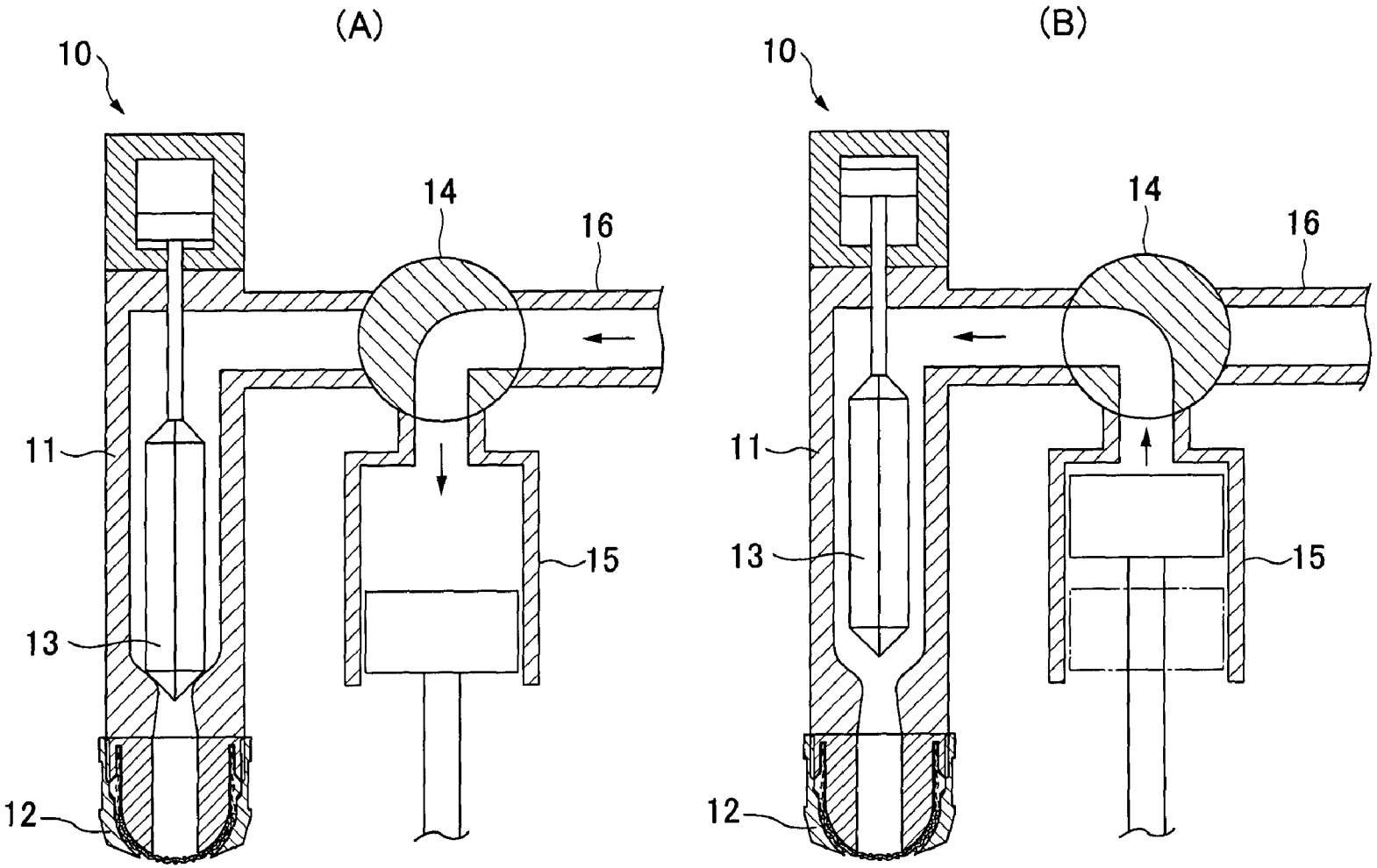
FIGS. 4(A) and 4(B) are schematic drawings showing the filling device.
Figure 5:
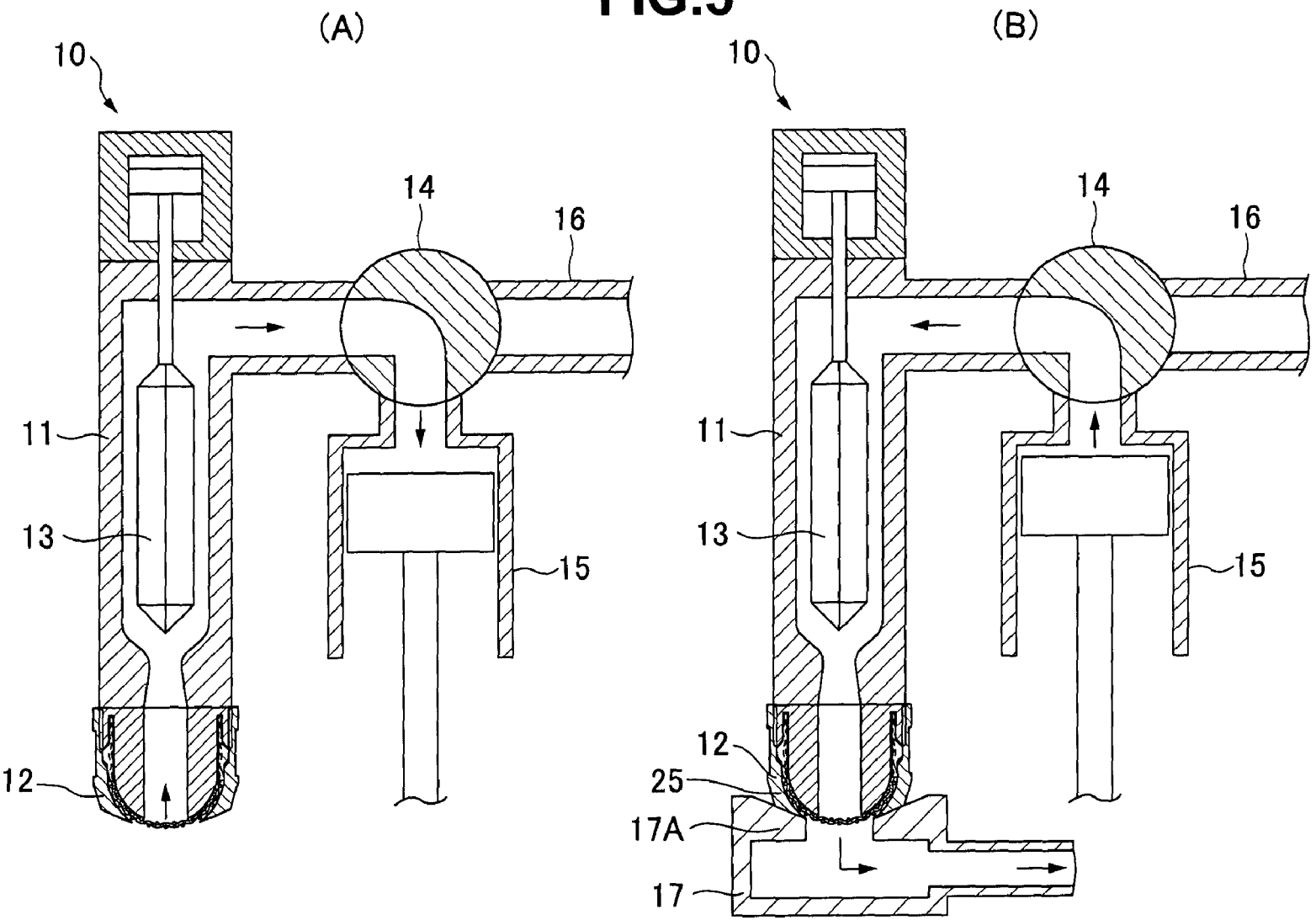
FIGS. 5(A) and 5(B) are schematic drawings showing the filling device.

A liquid filling operation into a bag (standing pouch) or the like by the liquid filling nozzle 10 according to the embodiment is similar to that in the embodiment 1 (FIGS. 4 and 5).

In the liquid filling device 10, the liquid dripping from the filling nozzle 12 after the filling has been finished is prevented as follows (FIGS. 13(A) to 13(D)).

(1) In filling from the filling nozzle 12 into the container, the liquid L is discharged from the discharge port 22 of the nozzle main body 21 through the net-like body 23 (FIG. 13(A)).

(2) When the filling from the filling nozzle 12 has been finished, the liquid is held by the net-like body 23 in a region of the opening 22A of the discharge port 22. The held liquid forms liquid accumulation (FIG. 13(B)).

(3) A part of the liquid in the opening 22A is drawn by the capillary action of the material body 30 having the capillary action outside the opening 22A, i.e., around the discharge port 22 and moves into the material body 30 having the capillary action (FIG. 13(C)). A part of the liquid forming the liquid accumulation in above-described (2) reaches the clearance 26 between the support 25 outside the opening 22A and the outer face of the nozzle main body 21.

(4) In the next filling from the filling nozzle 12, by the action of a negative pressure exerted on the periphery by the liquid discharged from the discharge port 22 of the nozzle main body 21 through the net-like body 23, the liquid accumulation in above-described (2) and the liquid that has moved to the peripheral portion of the discharge port 22 and the clearance 26 are discharged outside the filling nozzle 12 together with the discharged liquid.

In order to prevent liquid dripping after the filling from the filling nozzle 12 has been finished, an area of the material body 30 having the capillary action is preferably 0.2 times an area of the discharge port of the opening 22A or larger and is more preferably equal to or larger than the area of the discharge port. Depending on a kind of liquid to be discharged, with regard to the liquid that causes the liquid dripping when the filling from the filling nozzle 12 has been finished, it is estimated that an expected minimum amount of liquid can be held by providing the material body 30 having the capillary action and the surface area that is 0.2 times the area of the discharge port and it is estimated that an expected maximum amount of liquid can be held by providing the material body 30 having the capillary action and the surface area that is equal to the area of the discharge port.

With the present embodiment, the following operation and effects can be exerted.

(a) In the filling nozzle 12, the net-like body 23 that functions as a means for making the discharged liquid flow straight to make the liquid flow straight is provided on the front face of the opening 22A facing the outside of the discharge port 22 in the nozzle main body 21. With this configuration, because the net-like body 23 directly faces the outside in a direction along the discharge direction of the liquid, the liquid remaining when the filling from the filling nozzle 12 has been finished may adhere to the meshes of the net-like body 23 existing in a region (inside the bore) of the opening 22A of the discharge port 22 and may be held in the meshes to form liquid accumulation but does not form the liquid accumulation that causes the liquid dripping on the external side of the net-like body 23.

(b) Because the material body 30 having the capillary action spreads to the periphery of the discharge port 22 when seen in the direction of discharge of the discharge port 22, when the filling has been finished, a part of the liquid that has adhered to the meshes of the net-like body 23 in the opening 22A of the discharge port 22 is drawn by the capillary action of the material body 30 having the capillary action and spreading outside the opening 22A and is held in the material body 30. The region in which the liquid is held by the net-like body 23 in the opening 22A of the discharge port 22 is extended outside the opening 22A by the material body 30 having the capillary action to thereby further prevent the liquid dripping.

(c) By attaching the support 25 to the outer periphery of the discharge port 22 of the nozzle main body 21 and providing the clearance 26 between the support (discharge port peripheral wall portion) 25 and the outer face of the nozzle main body 21, when the filling from the filling nozzle 12 has been finished, a part of the liquid that has adhered to the meshes of the net-like body 23 in the opening 22A of the discharge port 22 is drawn into the clearance 26 between the support 25 outside the opening 22A and the outer face of the nozzle main body 21 and is held in the clearance 26 to thereby further prevent the liquid dripping.

(d) The liquid held in the meshes of the net-like body 23 existing in the opening 22A of the discharge port 22 in above-described (a), the liquid held in the material body 30 having the capillary action outside the opening 22A in above-described (b), and the liquid held in the clearance 26 between the support 25 and the outer face of the nozzle main body 21 in above-described (c) are respectively discharged outside the filling nozzle 12 together with the discharged liquid by the action of the negative pressure exerted on the periphery by the liquid discharged from the discharge port 22 in the next filling from the filling nozzle 12. Therefore, it is possible to reduce a possibility that the liquids in above-described (a) to (c) grow into the liquid accumulation to thereby prevent the liquid dripping caused by the liquid accumulation that takes a long time to form.

In carrying out the invention, the net-like body 23 may be provided while slightly spaced outward in the discharge direction of the discharge port 22 from the opening 22A as long as the net-like body 23 is close to the opening 22A of the discharge port 22.

The net-like body 23 and the material body 30 having the capillary action may be an integral body by being molded integrally.

As the material body 30 having the capillary action, a rigid resin porous body such as polypropylene, sintered metal of stainless steel or brass, sponge, and the like can be employed.

The porous body forming the material body 30 having the capillary action has a satisfactory liquid holding property to reduce the liquid dripping when the porous body has an average hole diameter of 0.27 to 1.56 mm and a thickness of 1 to 3 mm. In this case, the liquid held in the material body 30 having the capillary action can be discharged satisfactorily along with a flow of the liquid discharged from the nozzle discharge port to thereby avoid the necessity for special maintenance for maintaining the liquid dripping preventing performance.

What is claimed is:

1. A liquid filling nozzle comprising:

a material having a capillary action;

a discharge port having an opening; and a material body, wherein the material is provided around the opening of the discharge port, the material is a net-like body, the net-like body being provided at or in a vicinity of an opening of the discharge port, and the material body is different from the net-like body and has a capillary action, the material body being brought in contact with an outer edge of the net-like body.

2. A liquid filling nozzle comprising a net-like body provided at a discharge port of a nozzle main body, wherein the net-like body is provided at or in a vicinity of an opening of the discharge port and a material body having a capillary action extends around the opening so as to be in contact with an outer edge of the net-like body.

3. The liquid filling nozzle according to claim 2, wherein the material body having the capillary action spreads around the opening of the discharge port in an area region at least 0.2 times an area of the discharge port of the nozzle main body or larger.

4. The liquid filling nozzle according to claim 2, wherein a discharge port peripheral wall portion is provided at an outer periphery of the discharge port of the nozzle main body and a clearance is provided between the discharge port peripheral wall portion and an outer face of the nozzle main body.

5. The liquid filling nozzle according to claim 4, wherein the clearance between the discharge port peripheral wall portion and the outer face of the nozzle main body widens as it approaches the discharge port.

6. The liquid filling nozzle according to claim 4, wherein the material body having the capillary action and extending around the discharge port of the nozzle main body is provided between the discharge port peripheral wall portion and the outer face of the nozzle main body.

* * * * *